United States Patent [19]

Gilmour

[11] 4,207,932

[45] Jun. 17, 1980

[54] AUTOMATIC FILLER TUBE AND BELL FLUSHING

[76] Inventor: Alfred J. Gilmour, 310 Hawthorne St., Waterloo, Ontario, Canada

[21] Appl. No.: 925,953

[22] Filed: Jul. 18, 1978

[30] Foreign Application Priority Data

May 25, 1978 [CA] Canada ..... 304068

[51] Int. Cl.[2] ..... B65B 3/04; B08B 3/02

[52] U.S. Cl. ..... 141/90; 134/80; 134/183; 141/91; 141/371

[58] Field of Search ..... 134/78–81, 134/152, 170, 183, 199; 137/238; 141/51, 89, 90, 91, 165, 172, 177, 282, 312, 367, 369, 370, 371, 372, 374, 392, 140; 222/148

[56] References Cited

U.S. PATENT DOCUMENTS

| | | | |
|---|---|---|---|
| 3,183,946 | 5/1965 | Tidwell | 141/371 |
| 3,205,920 | 9/1965 | Cozzoli et al. | 141/90 |
| 3,524,483 | 8/1970 | Smith | 134/170 X |
| 3,789,889 | 2/1974 | Riedel | 141/140 |

FOREIGN PATENT DOCUMENTS

| | | | |
|---|---|---|---|
| 599012 | 10/1959 | Italy | 141/90 |

*Primary Examiner*—Frederick R. Schmidt
*Attorney, Agent, or Firm*—Wenderoth, Lind & Ponack

[57] ABSTRACT

In a known type of bottle filling machine, a bottle travels on a platform which is raised so that the bottle encircles a filler tube and sealingly engages a filler bell which is slidable up and down on the filler tube. If a bottle explodes during filling, particles of glass can adhere to the filler tube and the filler bell and it is obviously desirable to clean off these glass particles so that they cannot get into a subsequent bottle. However, with the presently known filler machine, when a bottle explodes the filler bell drops to the end of the filler tube and is suspended just above the platform on which a bottle rides. This makes access to the underside of the bell difficult and hence makes it difficult to spray water to clean off the underside of the filler bell and the filler tube. At present, it is known to have an operator manually flush the tube and bell with a low pressure water spray but this is a slow and inefficient operation. The present invention overcomes these problems by providing a bell which has an outwardly extending flange with a radius greater than the radius of the guide surface of a bottle guide provided on the platform whereby the bell is prevented from falling to the lower end of the filler tube by engagement of the flange with the guide. A plurality of spray nozzles are provided which spray cleaning liquid, e.g. water, so as to first engage the flange and push the bell up the filler tube, after which the cleaning liquid can flush the underside of the bell and the filler tube. The spray is preferably under high pressure. By providing the nozzles in groups, the bell is allowed to drop one or more times between groups to shake off particles and water. An air spray may be provided after the water sprays to remove excess water.

7 Claims, 9 Drawing Figures

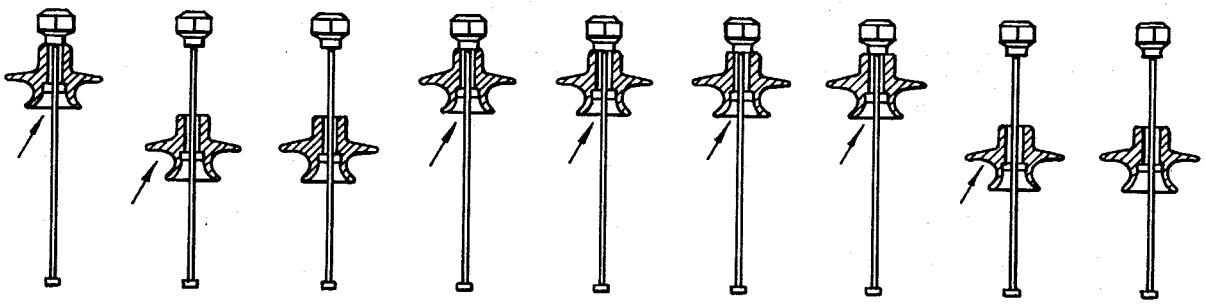
FIG. 6
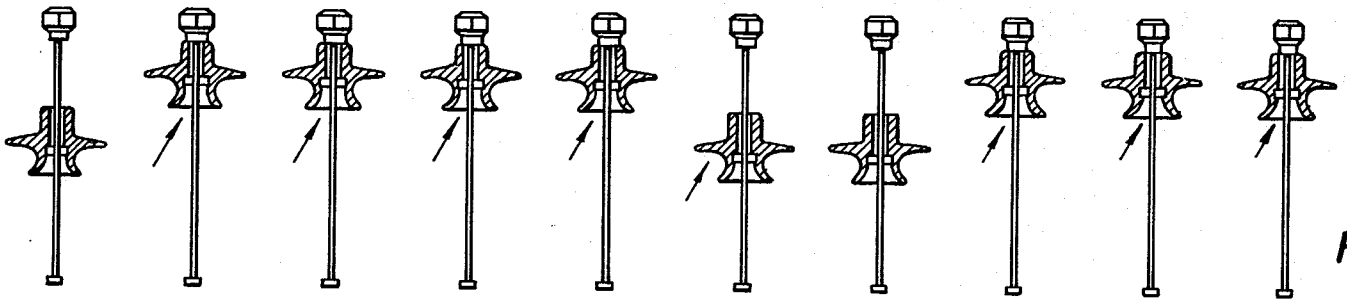
FIG. 7
FIG. 8
| FIG. 7 | FIG. 6 |
|---|---|

AUTOMATIC FILLER TUBE AND BELL FLUSHING

BACKGROUND OF THE INVENTION

This invention relates to an improvement in bottle filling machines.

Bottle filling machines have been known for many years. In one very common type of bottle filling machine, the bottles are carried on platforms which are raised by a cam type of mechanism so that each bottle is raised to encircle a filler tube and sealingly engage with a filler bell which is slidable up and down the filler tube. When a bottle is in the upper position, its mouth is sealed by a resilient seal at the top of the mouth of the bell and liquid enters the bottle through the filler tube. Frequently, this liquid is under pressure, e.g. beer or carbonated drinks, and occasionally a bottle will explode. An exploding bottle can cause glass fragments to adhere to the underside of the bell and to the filler tube. It is obviously desirable to remove these glass particles so that they cannot enter a subsequent bottle. Indeed, in some jurisdictions, there may be legislation requiring that steps be taken to ensure that bottles are not sold which contain glass particles. Of course there is, in any case, the danger of a possibly expensive lawsuit if a consumer suffers harm from ingesting glass particles from a bottle of beer or other liquid. There is, therefore, a clear need for some way to ensure removal of glass particles from the filler tube and bell.

At present, it is known to manually apply a spray of low-pressure water to clean the filler tube and bell but this is a rather slow and inefficient operation. The slowness of the operation results in lost production and hence is costly. Low-pressure water has been used in order not have it spray into the bottle filling machine and get on or in other bottles in the filler machine.

Low-pressure water may, of course, not remove all of the glass particles.

When a bottle explodes, the bell, in equipment current in use, drops down to the end of the filler tube so that the mouth of the bell is only slightly above the platform on which the bottle was being carried. This means that it is very difficult to direct a spray of water to the underside of the bell because of the interference of the platform.

SUMMARY OF THE INVENTION

The present invention seeks to enable rapid cleaning of the bell and filler and this is preferably done automatically although it may also be done manually. An important feature of the invention is a new type of bell which includes an outwardly extending flange, preferably near its mid-section. This flange is deliberately given a diameter such that it can rest on the bottle guide with which the platform is already provided. Thus, if a bottle explodes, the bell drops but only until the flange comes to rest on the top of the bottle guide. This means that the mouth of the bell is maintained at a level above the platform so that a high-pressure water spray may be directed upwardly against the bell. The water spray first engages the flange which flips the bell up to the top of the filler tube, after which the spray engages within the mouth of the bell and thoroughly cleanses it and the filler tube.

Thus, in accordance with the broadest aspect of the invention, there is provided, in a bottle filling machine in which a bottle is supported on a platform which is raised to encirle a filler tube and to sealingly engage a filler bell slidable on said filler tube, said platform having a bottle guide with an arcuate guide surface of radius substantially equal to the radius of the bottle, the improvement in which said bell has an integral outwardly extending flange with a radius greater than the radius of the guide surface whereby said bell is prevented from falling to the lower end of the filler tube by engagement of said flange with said guide said flange having upper and lower surfaces which slope slightly downwardly, said bell having an outer wall surface extending downwardly from the top of the bell and facing outwardly at the lower end of the bell, said flange bieng approximately midway between the top and bottom of the bell and having upper and lower surfaces which unite with said outer wall surface via smooth transitional curves.

BRIEF DESCRIPTION OF THE DRAWING

FIGS. 6 and 7, which go together as shown in FIG. 8, show a spray arrangement which has been found to produce good results in practice of the present invention.

DESCRIPTION OF THE PREFERRED EMBODIMENT

Figure 5:
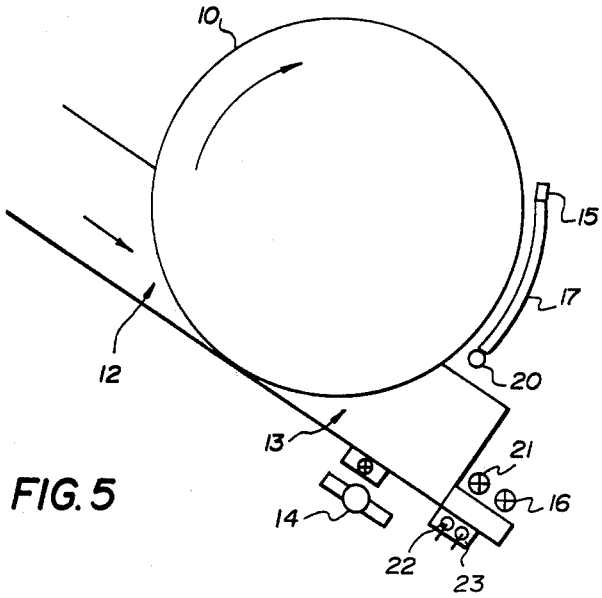
FIG. 5 shows the spray stand in relation to the filler apparatus.

Referring first to FIG. 5 of the drawings, bottles to be filled are conveyed to the filler machine 10 by a conveyor device and are picked up by the filler machine 10 in the region 12. After filling, they are discharged in the region 13. If a bottle should explode, the absence of a bottle on a platform is detected by a sensor 15 which activates a water solenoid 16 to supply water to the spray stand 17 to clean the associated filler tube and filler bell, as will be further explained later. After passing the spray stand 17, the filler tube, bell and stand may be blown substantially dry by an air blast from the air manifold 20, this being controlled by the air solenoid 21. In case the electrical control circuitry, not shown, should malfunction, an operator 14 may actuate the air and water solenoids by means of manual controls 22 and 23.

Figure 4A:
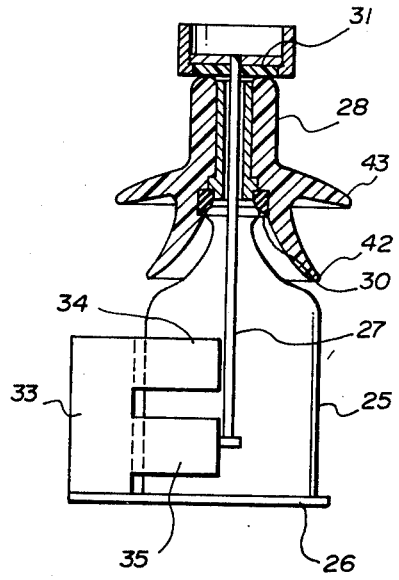
FIGS. 4(*a*) and 4(*b*) illustrate a bottle on a platform engaged by a filler bell, FIG. 4(*a*) being an elevational view and FIG. 4(*b*) being a top plan view.
Figure 4:
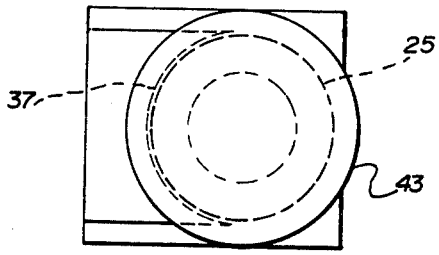

FIG. 4(*a*) shows a bottle 25 on a platform 26. The platform 26 is shown in the raised position which results in the bottle 25 encircling the filler tube 27 and sealingly engaging with the filler bell 28. Specifically, the mouth of the bottle engages with a resilient seal 30 of, for example, rubber or other suitable material. Also, the top of the bell 28 engages with a resilient seal 31. Liquid for filling the bottle 25 enters the bottle through the filler tube 27.

The platform 26 is provided with a bottle guide 33 which may, for example, comprise two arms 34 and 35 of resilient material such as rubber. As best seen in FIG. 4(*b*) the arms 34 and 35 have an arcuate bottle guiding surface 37 which is of substantially the same radius as the bottle 25. Reference will again be made to these figures later on in this description.

Figure 2:
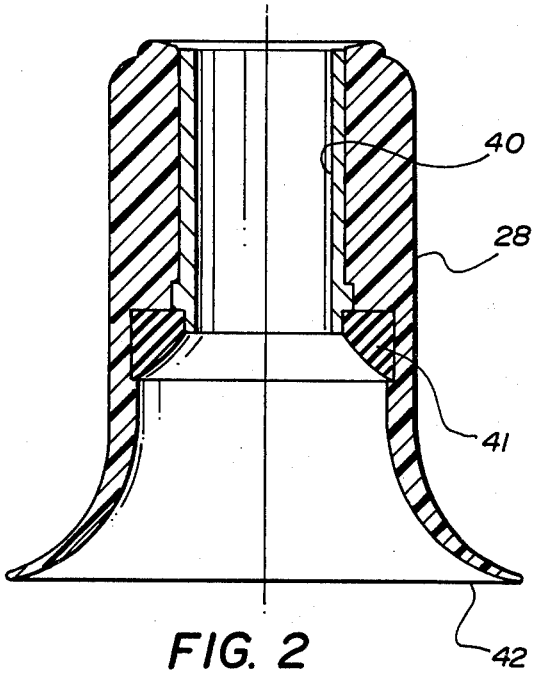
FIG. 2 is a cross-sectional diagram of a known type of filler bell.

FIG. 2 shows a known type of filler bell 28. The bell itself is preferably made of a high-impact plastic material, such as that sold under the trade mark Delrin. Retained within the bell 28 is a bushing 40 of metal, the inner wall of which slides with a loose fit on the filler tube 27. See also FIG. 4(*a*). Also retained within the filler bell 28 is a seal of resilient material 41 which closes off the mouth of a bottle being filled, in the manner shown in FIG. 4(*a*).

The mouth 42 of the bell 28 of known construction has a radius smaller than the radius of curvature of guide surface 37 shown in FIG. 4(*b*). Thus, if a bottle explodes, the filler bell 28 can drop to the end of the filler tube and will rest just above the platform 26. Access to the mouth of the bell is therefore difficult.

Figure 3:
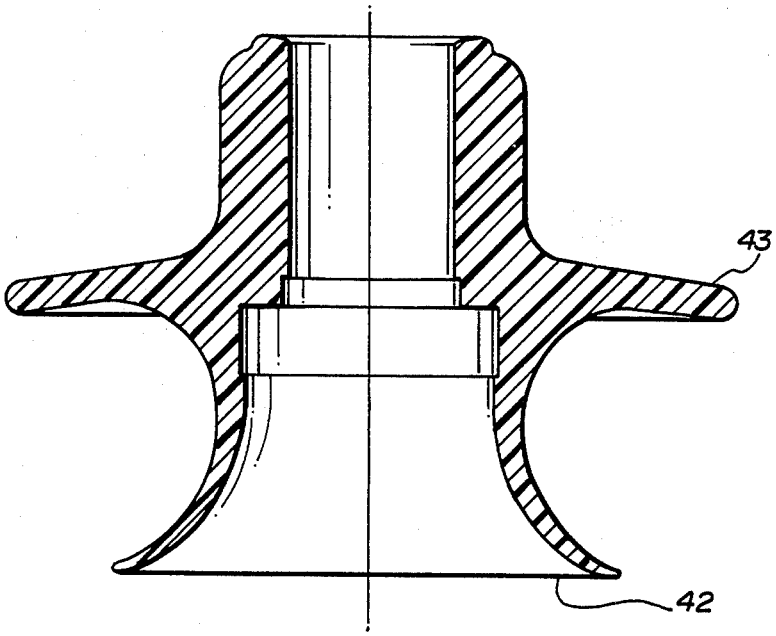
FIG. 3 is a cross-sectional drawing of a bell in accordance with the present invention.

Referring now to FIG. 3 a bell in accordance with the present invention is shown. It is similar to the known type of bell shown in FIG. 2 except that it further comprises a flange portion 43. As may be seen from FIGS. 4(*a*) and 4(*b*), the flange 43 has a larger radius than the mouth 42 of the bell and also larger than the radius of curvature of said surface 37. Therefore, with this type of bell, if a bottle explodes, the bell only falls until the flange 43 comes to rest on the top of guide 33. It does not drop to the end of the filler tube. In this position, a spray of water may be directed up under the flange from the front, as viewed in FIGS. 4(*a*) and 4(*b*), i.e. from the front of the filler machine. Such a spray of water can lift the bell up to the top of the filler tube, after which the spray hits the mouth of the bell and the filler tube to dislodge any glass particles which may have adhered there.

Figure 1:
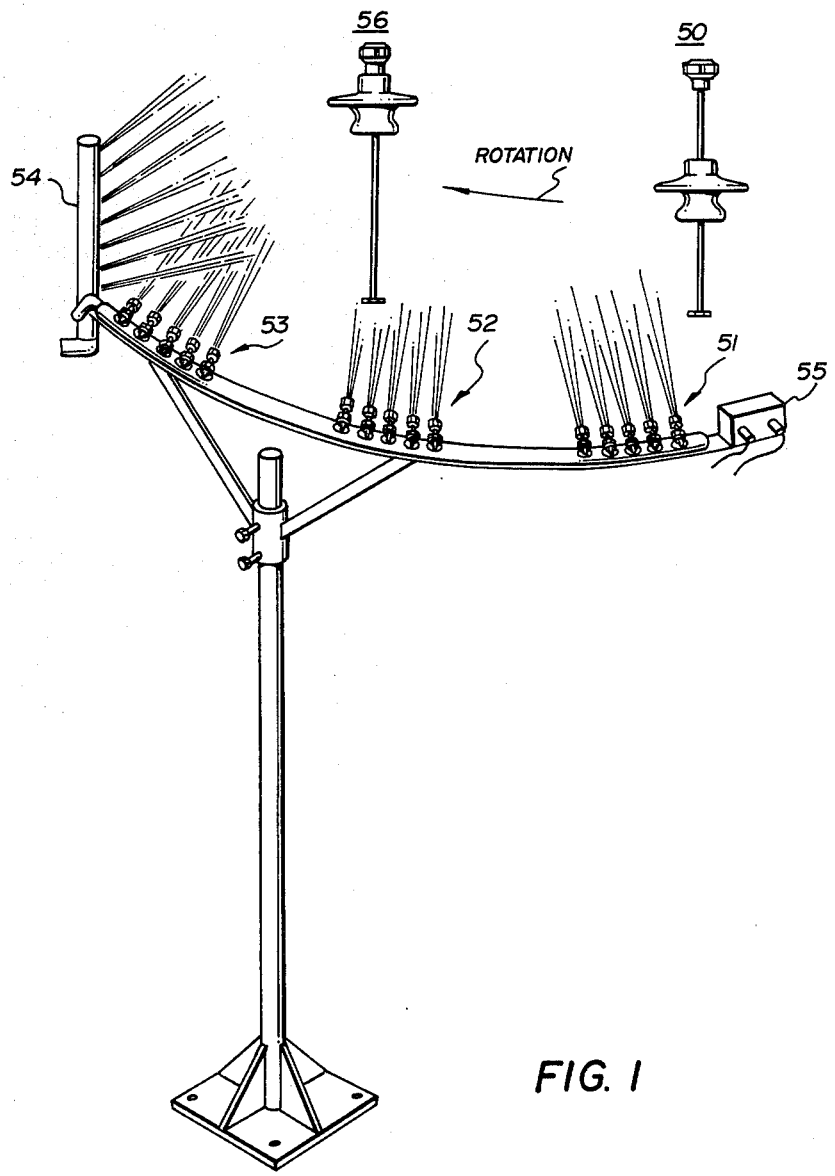
FIG. 1 shows a spray stand in accordance with the invention together with two filler tubes and bells in different positions with respect to the spray stand.

FIG. 1 illustrates two positions of a bell and filler tube. At position 50, the bell and filler tube have not yet entered the path of water sprayed from nozzles 51 and the bell is relatively low on the tube, being retained as shown in FIGS. 4(*a*) and 4(*b*) by guide 33. Position 56 shows a bell in accordance with the invention at the top of the tube, it being assumed that a water spray has lifted it there.

FIG. 1 shows the nozzles being divided into three groups 51, 52 and 53. In between groups 51 and 52 and between 52 and 53, the bell drops down and hits the guide 33 (not shown in FIG. 1) and this causes jarring of the bell which further aids in dislodging glass particles.

FIG. 1 also shows an air blast arrangement 54 which follows the spray stand. This tends to dry the bells and filler tubes.

During normal operation, a platform will be lower (typically by one half inch) if it has a bottle on it than if it does not. This difference in platform height is readily detected by sensors 55, e.g. magnetic or photosensors, to activate the air and water solenoids 16 and 21 (FIG. 5). Two separate sensors may be provided in case two bottles in rapid succession should explode. A timer is activated by the sensors to keep the air and water sprays on for a preset time sufficient to allow the bell and filler tube being cleaned to travel past the sprays.

FIGS. 6 and 7, which fit together as shown in FIG. 8, illustrate a spray pattern which may be used. Starting at the right of FIG. 6, a bell is initially in a relatively low position, resting on the guide 33, not shown in FIG. 6. It then enters a spray, indicated by an arrow, and the bell gets lifted to the top of the filler tube where it remains until the seventh position where there is no spray. The bell then drops to shake off water and particles. The bell again encounters a jet of water which hits the flange and shoots the bell back to the top of the filler tube after which the jet of water hits the inside of the mouth of the bell. The water is under high pressure, e.g. 50 to 100 lbs/sq. inch, and creates a very turbulant flow which swirls around and down to wash off glass particles. By angling the spray, the bell can be caused to rotate. A very thorough cleansing action is ensured. The upward turning movement of the filler bell exposes the lower inside area of the bell and allows the water sprays to flush extensively in the critical areas where glass fragments tend to be lodged.

Preferably, each individual nozzle is adjustable as regards the direction in which it can direct a spray. This allows great flexibility in spray patterns to be achieved.

As shown on FIG. 3, all edges and corners on the bell are rounded to avoid the collection of bacteria or fungus. The flange is approximately mid-way between the top and bottom of the bell and has upper and lower surfaces which unite with the outer wall surface via smooth transitional curves.

An incidental but highly useful advantage of the present invention is that it eliminates another problem on the filler machine. Bacteria and fungus tend to gather in a crevice in the filler machine above the filler tube and filler bell. By using the present invention, the excess water from the flushing action also flushes out this bacteria gathering area as well as flushing the filler bell and tube.

The air spray not only blows excess water from the underside of the filler bell, but also blows off any glass chips which might still be laying on the platform.

Although a preferred embodiment of the invention has been disclosed it will be evident that various modifications are possible. For example the water spray nozzles could be divided into less than or more than three groups and the flange on the filler bell could be more towards the top or bottom of the bell.

Although not illustrated in the drawings, the inside surface of bushing 40 may have spiral grooves ("rifling") and water sprayed into the bell will react with these grooves to spin the bell, thus aiding the cleaning action.

What I claim as my invention is:

1. In a bottle filling machine in which a bottle is supported on a platform which is raised to encircle a filler tube and to sealingly engage a filler bell slidable on said filler tube, said platform having a bottle guide with an arcuate guide surface of radius substantially equal to the radius of the bottle and said platform, bell and filler tube travel past a spray stand having a plurality of spray nozzles, means being provided to detect the absence of a bottle on the platform and activate the spray nozzles, said nozzles being arranged to spray high pressure cleaning liquid upwardly against the bell, the improvement in which said bell has an integral outwardly extending flange with a radius greater than the radius of the guide surface whereby said bell is prevented from falling to the lower end of the filler tube by engagement of said flange with said guide the lower surface of said flange being hit by said liquid which causes the bell to slide up the filler tube to allow the cleaning liquid to enter the lower end of the bell, said flange having upper and lower surfaces which slope slightly downwardly, said bell having an outer wall surface extending downwardly from the top of the bell and facing outwardly at the lower end of the bell, said flange being approximately midway between the top and bottom of the bell and having upper and lower surfaces which unite with said outer wall surface via smooth transitional curves.

2. The improvement defined in claim 1 in which at least some of said nozzles are arranged so that the spray causes the bell to rotate.

3. The improvement defined in claim 2 wherein said nozzles are arranged in groups so that when the bell travels between groups it drops to the lower end of the filler tube.

4. The improvement defined in claim 3 wherein the cleaning fluid is water.

5. The improvement defined in claim 4 wherein the water is sprayed with a pressure of at least 50 pounds per square inch.

6. The improvement defined in claim 5 wherein said spray stand is followed by an air spray device to further clean the bell and filler tube.

7. The improvement defined in claim 6 wherein means are provided for manually operating the spray nozzles and air spray device.

* * * * *